US005771061A

United States Patent [19]

Komurasaki et al.

[11] Patent Number: 5,771,061

[45] Date of Patent: Jun. 23, 1998

[54] IMAGE FORMING APPARATUS HAVING TWO-BEAM OPTICAL SCANNING UNIT WITH MOVABLE LASER BEAM EMITTERS AND SEPARATE DYNAMIC AND PRECISION ADJUSTING OF LASER BEAMS

[75] Inventors: Takeshi Komurasaki; Shinji Morita; Junichi Otani, all of Tokyo, Japan

[73] Assignee: Konica Corporation, Tokyo, Japan

[21] Appl. No.: 518,779

[22] Filed: Aug. 24, 1995

[30] Foreign Application Priority Data

Aug. 29, 1994 [JP] Japan ..... 6-203799

[51] Int. Cl.[6] ..... B41J 2/47

[52] U.S. Cl. ..... 347/242; 347/257

[58] Field of Search ..... 347/242, 243, 347/241, 256, 257, 258, 259, 260

[56] References Cited

U.S. PATENT DOCUMENTS

| | | | |
|---|---|---|---|
| 4,725,855 | 2/1988 | Arimoto et al. | 347/257 |
| 4,878,066 | 10/1989 | Shiraishi | 347/243 |
| 5,006,705 | 4/1991 | Saito et al. | 347/243 |

FOREIGN PATENT DOCUMENTS

| | | |
|---|---|---|
| 58-68016 | 4/1983 | Japan . |
| 62-86324 | 4/1987 | Japan . |
| 63-50809 | 3/1988 | Japan . |

*Primary Examiner*—Mark J. Reinhart
*Attorney, Agent, or Firm*—Frishauf, Holtz, Goodman, Langer & Chick

[57] ABSTRACT

An image forming apparatus, such as a copying machine or a printer having a two-beam optical scanning unit, includes a pair of semiconductor laser beam emitters, each emitter generating a respective laser beam. A beam composition prism composes the two laser beams and a photoreceptor is provided for holding an image written with the two laser beams. A defector deflects the two laser beams onto the photoreceptor in a primary scanning direction so that the two laser beams are emitted on a primary scanning plane. Two supporting members each respectively supports one of the pair of semiconductor laser beam emitters. A moving member is provided for moving at least one of the two supporting members so that at least one of the two laser beams is movably adjusted so as to have a predetermined emitting direction.

10 Claims, 8 Drawing Sheets

IMAGE FORMING APPARATUS HAVING TWO-BEAM OPTICAL SCANNING UNIT WITH MOVABLE LASER BEAM EMITTERS AND SEPARATE DYNAMIC AND PRECISION ADJUSTING OF LASER BEAMS

BACKGROUND OF THE INVENTION

In a conventional image forming apparatus, a recording operation is performed by writing to a photoreceptor with a laser beam; therefore, the image forming apparatus consists of a semiconductor laser emitting body to generate a laser beam and a collimator lens or the like, which are formed in a single unit for an optical scanning system in an exposure unit. When a recording operation by writing with two beams is performed, two sets of the units, in each of which the semiconductor laser emitting body and the collimator lens or the like are unitedly formed, are provided.

However, in this case, the optical scanning paths of the two beams need to be arranged precisely. Conventionally, a precise adjustment of the optical scanning paths in the subsidiary scanning direction is, for example, disclosed as the way that the pitch adjustment in the subsidiary scanning direction is performed with one prism (Japanese Patent Publication Open to the Public Inspection Nos. 58-68016/1983, and 63-50809/1988) and as the way that the adjustment is performed by moving the single unit, consisting of the semiconductor laser unit, in the subsidiary scanning direction (Japanese Patent Publication Open to the Public Inspection No. 62-86324/1987).

As explained above, in the conventional technologies, the adjustment of the optical scanning paths in the subsidiary scanning direction is performed. Further, there is a conventional way that a discrepancy in the primary scanning direction is adjusted by detecting the discrepancy of the two beams with an index sensor and delaying the signals electrically. However, when the discrepancy of the two beams is large, it is impossible to compensate the discrepancy completely. In other words, if the incident position of one of the two beams is discrepant in the primary scanning direction in relation to the another one of the two beams, the scanning focal positions of the two beams are discrepant from each other.

When the two beams, generated from two semiconductor laser emitting bodies, are composed by a beam composition prism, if the location error of the beam composition prism occurs, there tends to be a problem that the beam at the reflection side of the beam composition prism has the discrepancy of its axis. For example, when the beam composition prism is positioned discrepant in a plane parallel to the axis of the beams, one beam, which is transmitted through the beam composition prism, is not affected but the another beam, which is reflected at the beam composition prism, is affected so that the irradiating direction of the beam becomes discrepant in the primary scanning direction. Especially, when the beam composition prism is fixed to a part of the optical scanning system with an adhesive, the precision of the beam arrangements is required to be very strict; therefore, when an adhesion mistake occurs or a shape precision at the adhesion surface is not ensured, the whole unit of the optical scanning system can be defective due to discrepancy of the beam axis. Further, the adhesion technique is not suitable for easy assembly. It requires a complicated inspection for the entire exposure unit after the adhesion.

SUMMARY OF THE INVENTION

Accordingly, the objective of the present invention is to solve the above explained problems and to prevent the recording apparatus, which writes with two beams, from the positioning discrepancy of two scanning beams, especially in the primary scanning direction.

In order to accomplish the above-described objects, the present invention provides the following apparatus and methods.

In a two-beam optical scanning unit for simultaneously scanning two lines and writing image data onto the surface of a photoreceptor by two beams generated from two sets of semiconductor laser beam emitting bodies, through a beam composition prism for composing the two beams, a deflector, and an image forming optical system, the beam position is adjusted by a moving unit for moving the two sets of semiconductor laser beam emitting bodies in parallel in a primary scanning direction, and an angle changing unit for changing the angles of the two sets of semiconductor laser beam emitting bodies in the primary scanning surface. The moving unit for moving the two sets of semiconductor laser beam emitting bodies in parallel in the primary scanning direction, is a unit which is moved relative to the base body of the beam optical scanning unit by the rotation of an eccentric cam. An angle changing unit for changing angles of the semiconductor laser beam emitting bodies, changes the angle by rotation of an eccentric cam rotated by a worm gear, from the position, to which the laser beam emitting body is moved with respect to the base body of the beam optical scanning unit by the moving unit. The beam position adjustment is carried out under the condition that the semiconductor laser emitting body is attached to the base body, and a beam position detection unit is provided on a portion of the base body. An opening is formed in one portion of the base body or the image forming apparatus between the semiconductor laser beam emitting body and the beam position detection unit, and the laser beam is detected by the beam position detection unit through the opening.

In a two-beam optical scanning unit for simultaneously scanning two lines and writing image data onto the surface of a photoreceptor by two beams generated from two sets of semiconductor laser beam emitting bodies, a beam composition prism for composing the two beams, a deflector, and an image forming optical system, the beam composition prism and a cylindrical lens are integrally fixed onto a stationary member, and the stationary member is provided on a portion of the two-beam optical scanning unit for writing.

In a two-beam optical scanning unit for simultaneously scanning two lines and writing image data onto the surface of a photoreceptor by two beams generated from two sets of semiconductor laser beam emitting bodies, a beam shaping optical system for shaping the two beams, a beam composition prism for composing the two beams, a deflector, and an image forming optical system, and a pair of prisms for compressing the two beams in the subsidiary scanning direction, a pair of prisms for adjusting beam pitches of the beams in the subsidiary scanning direction, a beam position adjusting unit for adjusting the beam position in the primary scanning direction by moving at least one of the two sets of semiconductor laser emitting bodies in parallel to the primary scanning direction, and a beam angle adjusting unit for adjusting the beam angle in the surface of the primary scanning direction, are provided in the apparatus. The beam pitch adjustment in the subsidiary scanning direction by the pair of prisms is carried out by the rotation adjustment of a screw. The adjustment of the beam position and the beam angle in the primary scanning direction is carried out by the eccentric cam and a pair of gears.

DETAILED DESCRIPTION OF THE INVENTION

Examples will be explained below with reference to the attached drawings of a two-beam optical scanning system unit of the present invention.

Figure 1:
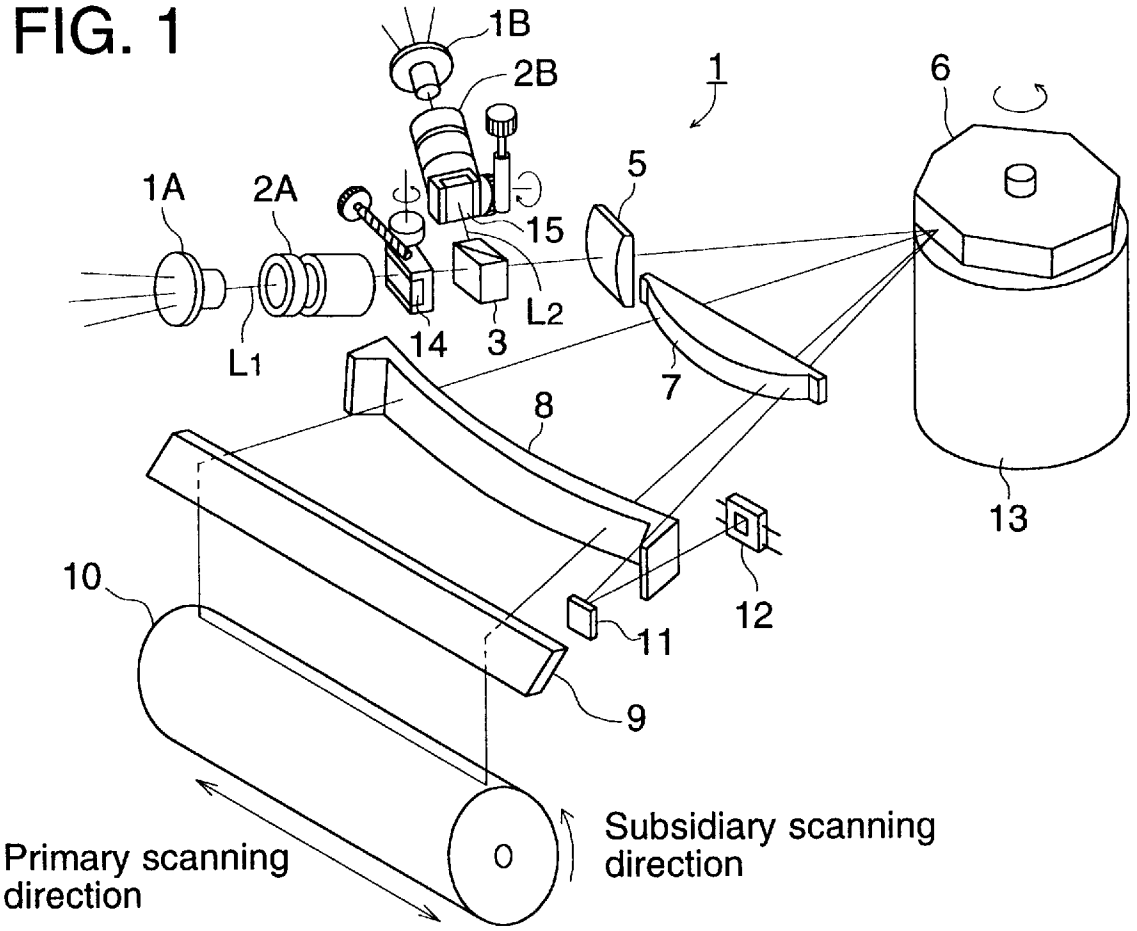
FIG. 1 is a perspective view showing the overall structure of a two-beam optical scanning unit of the present invention.

FIG. 1 is a view of a comprehensive structure showing an example of a two-beam optical scanning unit.

In FIG. 1, numerals 1A and 1B represent semiconductor laser beam emitting bodies. Numerals 2A and 2B are collimator lenses (an optical system for beam shaping). Numerals 14 and 15 are prisms for the primary and subsidiary scanning adjustment. Numeral 3 is a beam composition prism. Numeral 5 is the first cylindrical lens. Numeral 6 is a polygonal mirror, and numeral 7 is an fθ lens. Numeral 8 is the second cylindrical lens, and numeral 9 is a mirror. Numeral 10 is a photoreceptor drum. Numeral 11 is a timing detection mirror, and numeral 12 is a synchronism detector. Numeral 13 is a driving motor for the polygonal mirror 6. A beam $L_1$ emitted from the semiconductor laser beam emitting body 1A is made parallel by the collimator lens 2A, and then enters into the beam composition prism 3. A beam $L_2$ emitted from the semiconductor laser beam emitting body 1B, arranged such that it is perpendicular to the semiconductor laser beam emitting body 1A, is also made parallel in the same way as in the semiconductor laser beam emitting body 1A by the collimator lens 2B, and then, enters into the beam composition prism 3. The pitch of this beam emitted from the semiconductor laser beam emitting body 1B is shifted by a predetermined value from the beam, and emitted from the semiconductor laser beam emitting body 1A in the subsidiary direction. Both beams enter into the polygonal mirror 6 through the first cylindrical lens 5 of the first image forming optical system. The reflected light passes through the second image forming optical system comprising of the fθ lens 7 and the second cylindrical lens 8, and simultaneously scans two lines with a predetermined spot diameter on the photoreceptor drum surface 10 under the condition that the pitch of one beam is shifted by a predetermined value from that of the other beam in the subsidiary scanning direction. In this connection, fine adjustment in the primary scanning direction is performed previously by an adjustment mechanism, which is not shown in the drawing.

In order to detect the synchronism of each line, a light beam enters into the synchronism detector 12 before the start of scanning through the mirror 11.

Figure 2:
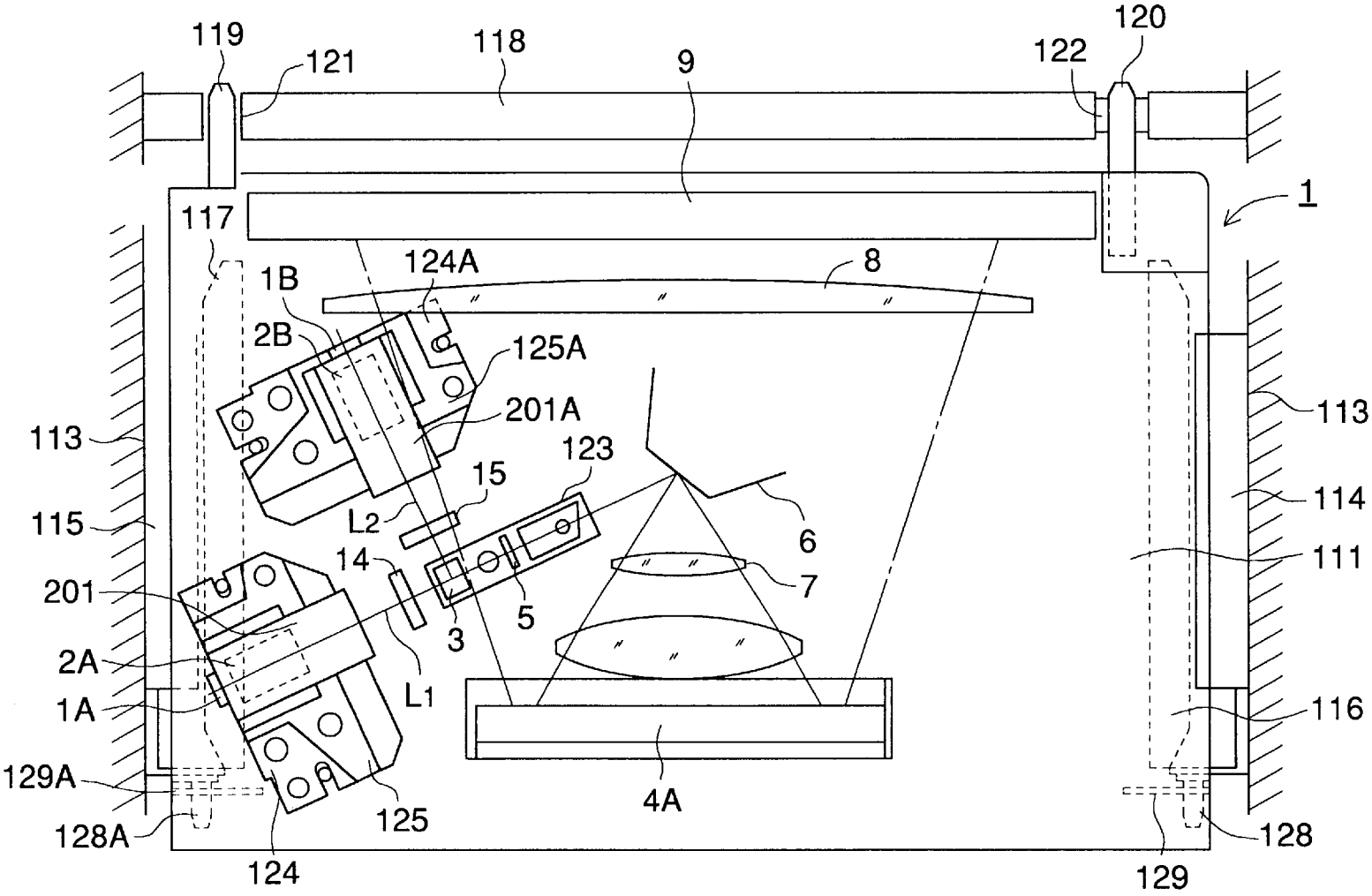
FIG. 2 is a plan view showing the overall structure of the two-beam optical scanning unit of the present invention.

FIG. 2 is a plan view of the two-beam optical scanning system unit 1. Casings 201 and 201A, in which semiconductor laser emitting bodies 1A and 1B, collimator lenses 2A and 2B are respectively provided, are arranged on a base member 111 as shown in the drawing, and beams $L_1$ and $L_2$ are emitted at an angle of 90° with respect to each other. The casings 201 and 201A are respectively arranged on angle changing members 125 and 125A. The angle changing members 125 and 125A are respectively located on parallel moving members 124 and 124A, which move in parallel in the primary scanning direction on the base member 111. Further, the beam composition prism 3 and the first cylindrical lens 5 are fixed by a supporting member 123. The beams $L_1$ and $L_2$ are composed by the beam composition prism 3. The supporting member 123 is fixed on the base member 111 so that the composed beam can enter into the polygonal mirror 6. In the optical scanning system unit 1, as shown in FIG. 2, both ends of the base member 111 are respectively located on the supporting members 114 and 115 provided in the image forming apparatus 113. The optical scanning system unit 1 is guided in the direction perpendicular to the beam scanning direction by guide members 116 and 117 respectively provided at both end positions of the base member 111, and located at a predetermined position. Further, in the front position toward which the optical scanning system unit 1 is guided, an engagement stay 118, which is used as a reference position, is provided in the image forming apparatus 113 in the same direction as the light beam scanning direction, and engaging claw members 119 and 120 are respectively provided on both end positions of the base member 111. These claw members are respectively engaged with groove portions 121 and 122 formed on the engagement stay 118. In the groove portions 121 and 122, the width of one groove portion 121 is formed the same as that of the engagement claw member 119, and the width of the other groove portion is formed larger than that of the engagement claw member 120, so that the engagement operation can be smoothly carried out, and the claw members can be accurately positioned. Further, positioning pins 128 and 128A are fixed so that the rear end of the base member 111 can be positioned in a predetermined position, and positioning members 129 and 129A for engaging with the positioning pins 128 and 128A, are respectively provided on the rear end of the base member 111.

Figure 3:
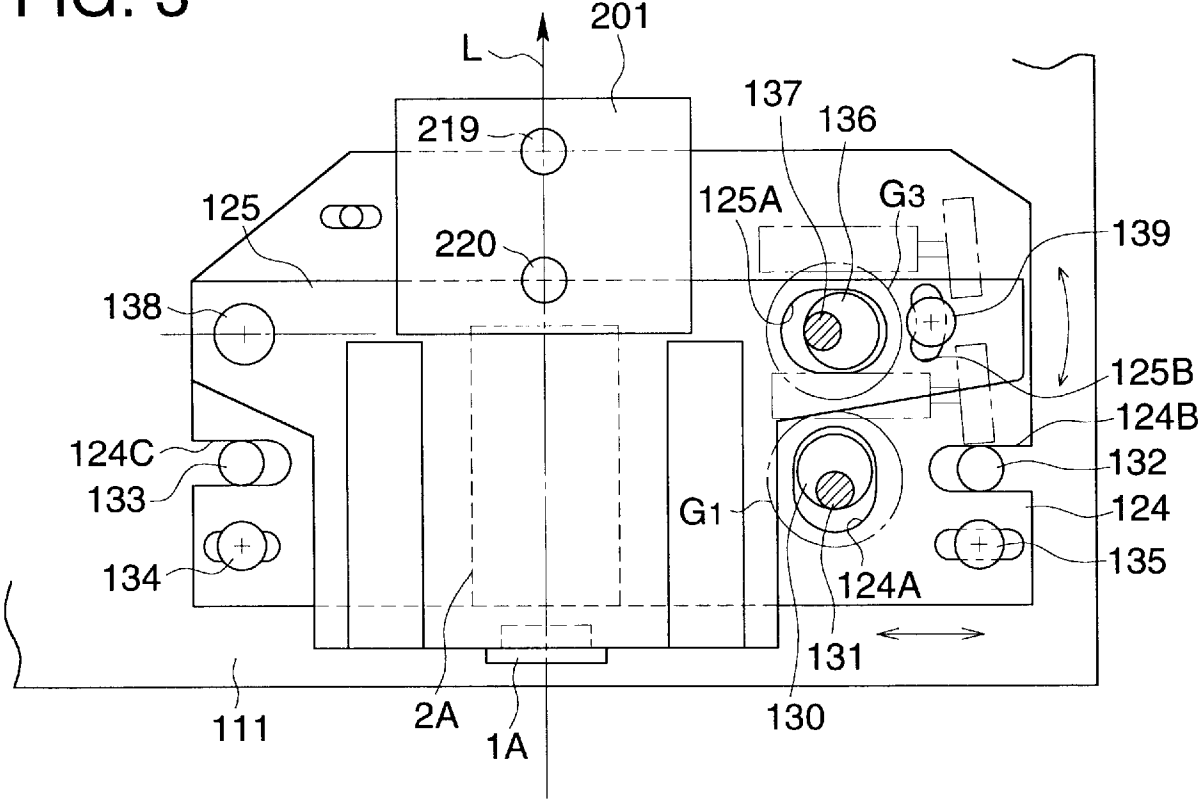
FIG. 3 is a plan view showing an adjusting unit of a light beam generating apparatus of the present invention.
Figure 4:
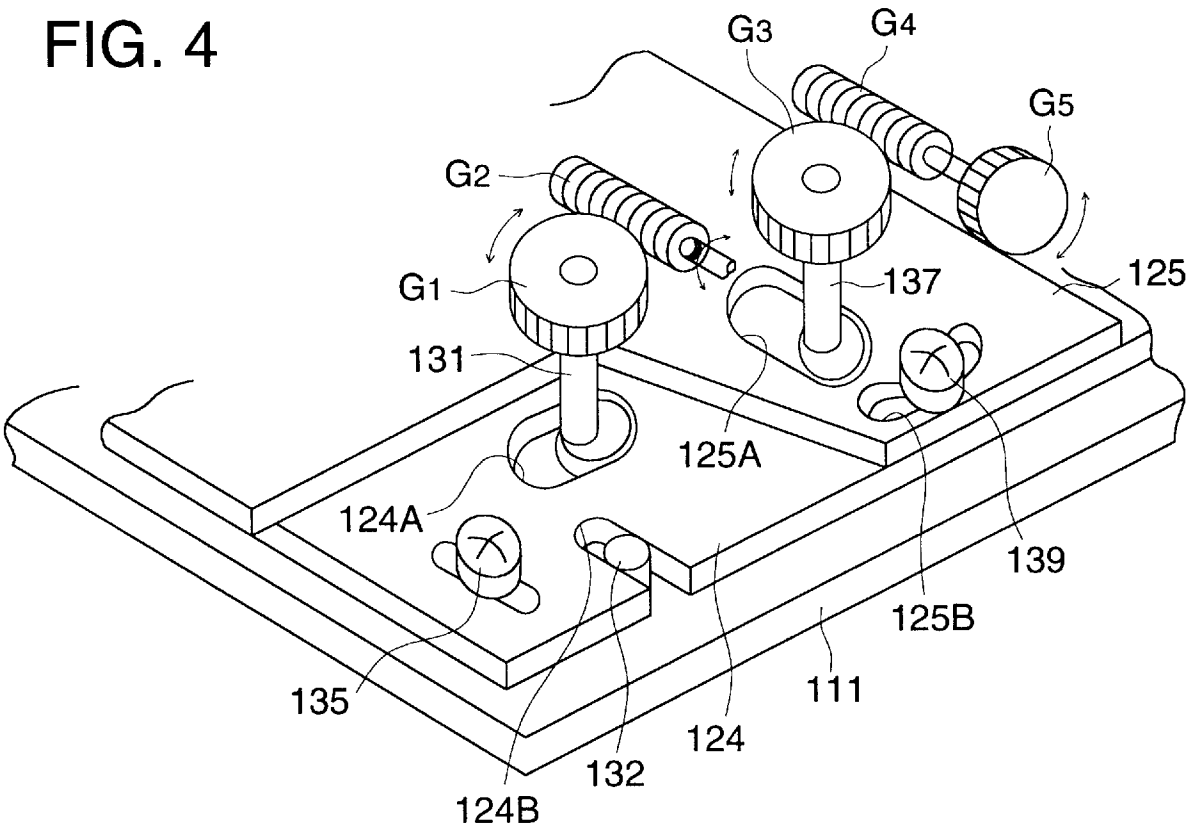
FIG. 4 is a perspective view showing the adjusting unit of the light beam generating apparatus of the present invention.

FIGS. 3 and 4 show the structure of the parallel moving member 124 and the angle changing member 125 provided on the base member 111. As shown in FIG. 3, the first guiding recesses 124B and 124C, formed on the parallel moving member 124 which moves in parallel in the primary scanning direction, are provided such that these recesses are engaged with guide members 132 and 133 provided on the base member 111, and the parallel moving member 124 is fixed onto the base member by fixing screws 134 and 135. The second cam groove 124A, which is engaged with the eccentric cam 130 provided on an axis 131, is formed on the base member 111. Further, the angle changing member 125 is located on the parallel moving member 124, and one end of the angle changing member 125 is rotatably provided around a shaft 138. The third cam groove 125A, which is engaged with the eccentric cam 136 provided on the axis 137, is formed on the other end of the angle changing member 125. A fixing screw 139 is provided which fixes the angle changing member 125 onto the parallel moving member 124 at the position at which the angle is changed. A casing 201, in which the semiconductor laser beam emitting body 1A and the collimator lens 2A are provided, is fixed on the angle changing member 125 in the direction of a beam $L_1$. Numerals 219 and 220 are screw rods for adjusting a prism 200 provided in the casing 201 (refer to FIG. 8).

Due to the above structure, the following operations are carried out when the parallel moving member 124 is moved parallely: initially, the hold by fixing screws 134 and 135 is released; the axis 131 is rotated and the eccentric cam 130 is rotated; and the parallel moving member 124 is moved in parallel in the right and left directions, shown by arrows, by the first guiding recesses 124B, 124C, and the guide members 132 and 133 provided on the base member 111, through the second cam groove 124A. Due to this movement, the casing 201 provided on the angle changing member 125 can be adjusted to move in parallel to the beam $L_1$. That is, the beam $L_1$ from the semiconductor laser beam emitting body 1A can be adjusted in the primary scanning direction. After adjustment has been completed, the parallel moving member 124 is fixed onto the the base member 111 by fixing screws 134 and 135. Next, when the angle of the angle changing member 125 is changed, initially, the hold by the fixing screw 139 is released; the eccentric cam 136, provided on the axis 137, is rotated so that the parallel moving member 124 is moved; and the angle changing member 125 is adjusted to rotate around the shaft 138 in the direction shown by the arrow, through the third cam groove 125A, by the rotation of the eccentric cam 136. Due to this adjustment, the angle of the casing 201 provided on the angle changing member 125 is adjusted with respect to the beam $L_1$. That is, the angle of the beam $L_1$ from the semiconductor laser beam emitting body 1A is adjusted.

In FIG. 4, as a rotation means of the axes 131 and 137 shown in FIG. 3, a worm gear $G_1$ and a worm $G_2$ are provided on the axis 131, and a worm gear $G_3$ and a worm $G_4$ are provided on the axis 137. When the worm $G_2$ or worm $G_4$ are rotated, and the worm gear $G_1$ or worm gear $G_3$ is rotated, fine adjustment can be performed through eccentric cams 130 and 136.

Figure 5:
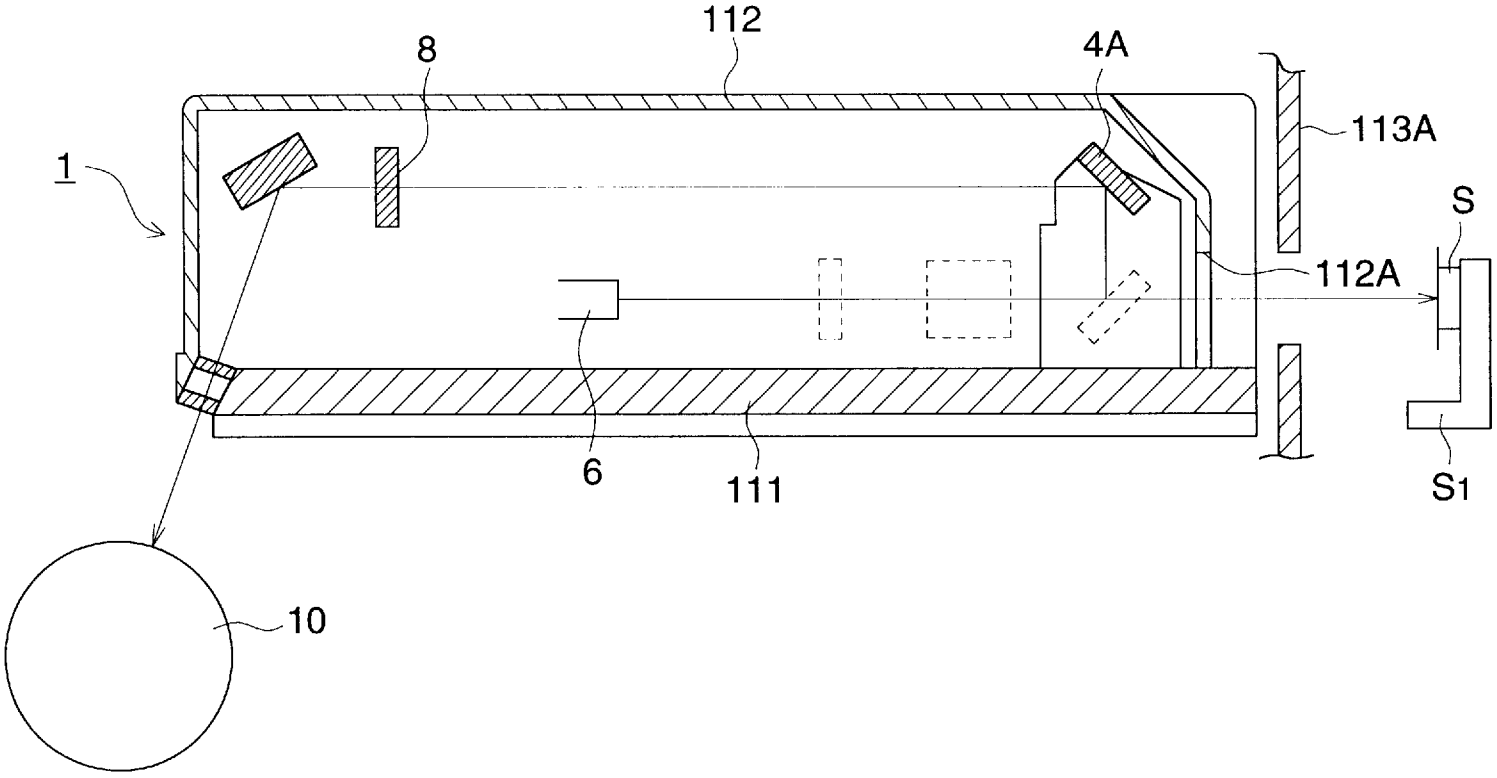
FIG. 5 is a view showing the structure of a light beam adjustment detecting apparatus of the present invention.

FIG. 5 shows a beam position detection means for adjusting beam $L_1$. Initially, as shown in the drawing, the optical member located between the polygonal mirror 6 and the photoreceptor drum 10 is removed. The beam position detection member S is arranged at a position at which the beam $L_1$ reflected from the polygonal mirror 6 is directly received, and a supporting body $S_1$, on which the beam position detection member S is provided, is arranged at the measuring position outside the apparatus. The beam $L_1$ is emitted from the semiconductor laser beam emitting body 1A under the above conditions, and the beam pitch is adjusted so that it is within a predetermined specification, using the above adjustment method. This adjustment is simultaneously carried out on the beam $L_2$ emitted from the laser beam emitting body 1B, and the beam adjustment in the primary and the secondary scanning directions can be carried out. Numeral 112 is a cover, and an opening 112A for measuring is formed in a portion of the cover 112. Numeral 113A is an outside board of the image forming apparatus 113 in which the opening 112A is formed.

Figure 6:
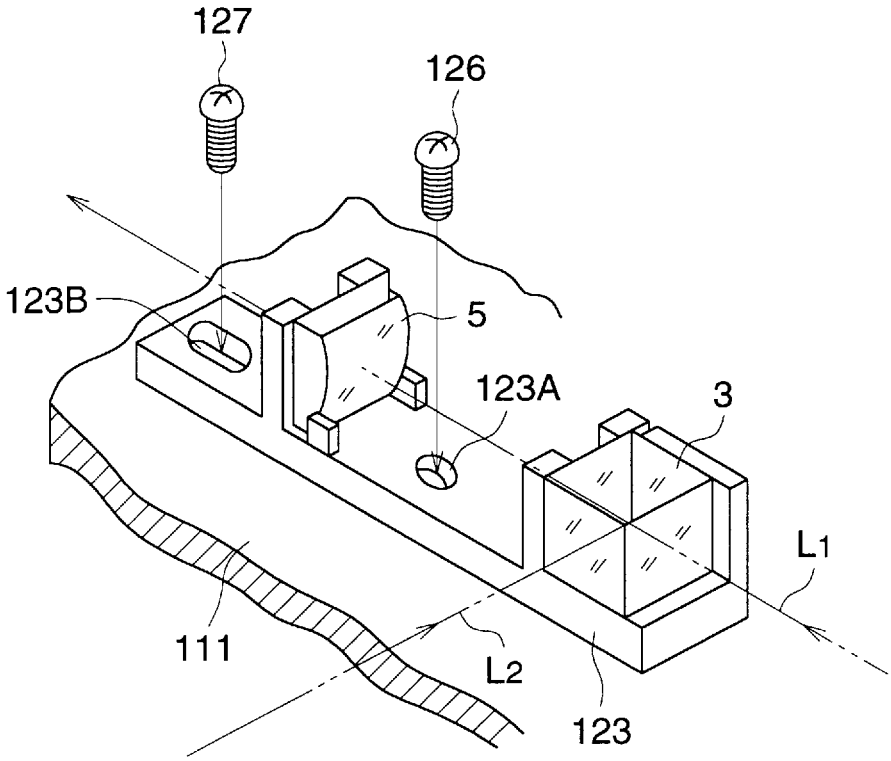
FIG. 6 is a perspective view showing a beam composition prism and a cylindrical lens of the present invention.

FIG. 6 shows a supporting member 123 on which the beam composition prism 3 and the first cylindrical lens 5 shown in FIG. 2 are fixed. The beam composition prism 3 and the first cylindrical lens 5 are integrally fixed on the supporting member 123. As a fixing method, an adhesive agent may be applied. Alternatively, the beam composition prism 3 and the first cylindrical lens 5 may be engaged and fixed on a holding portion, as shown in the drawing, which is integrally formed with the supporting member 123. The supporting member 123 is fixed on the base member 111 by fixing screws 126 and 127.

Figure 7:
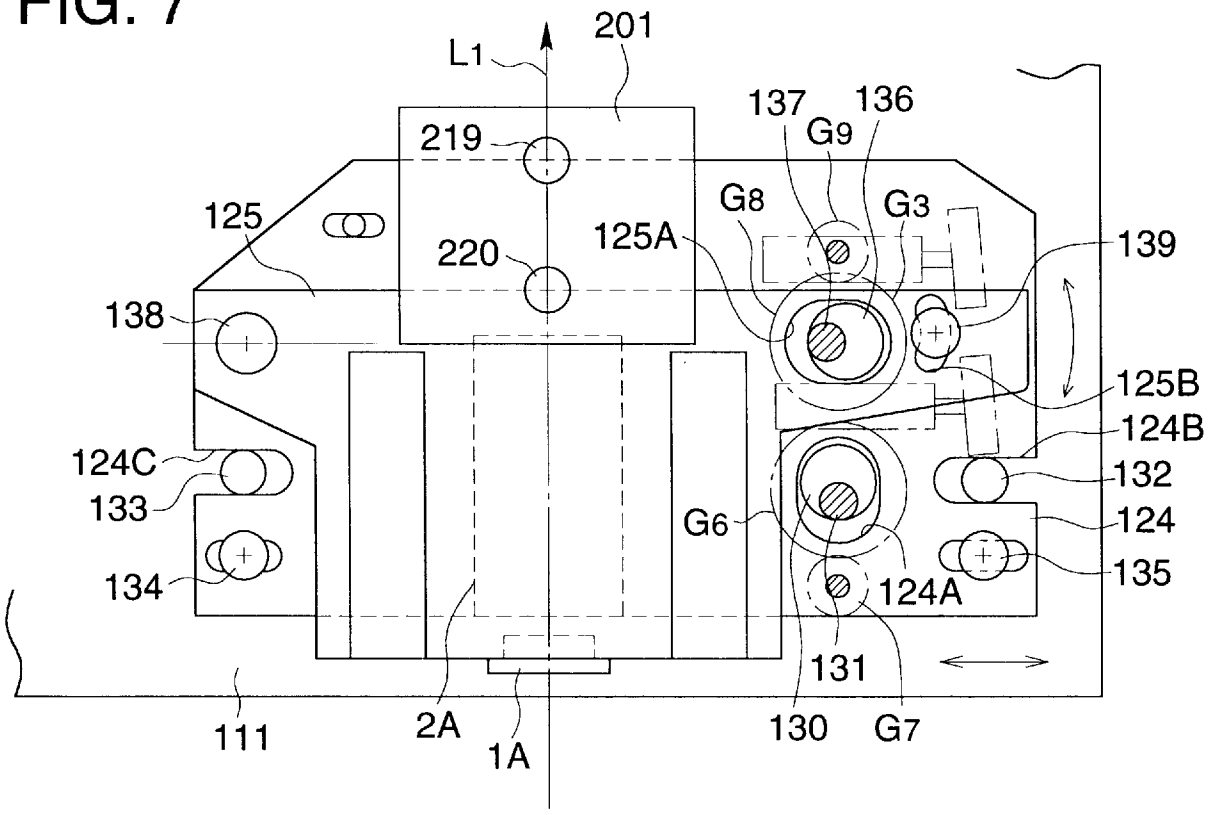
FIG. 7 is a plan view showing the adjusting unit of the light beam generating apparatus of the present invention.
Figure 8:
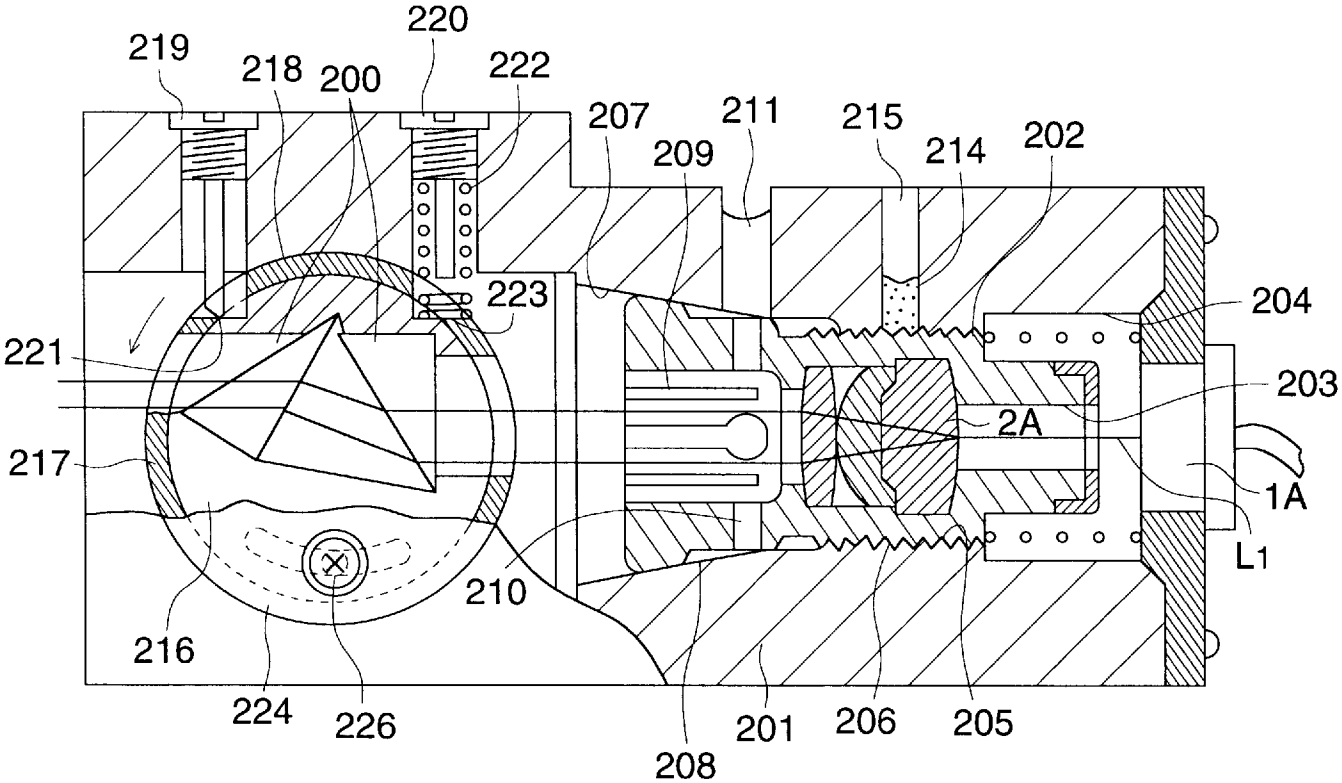
FIG. 8 is a vertical sectional view of a casing of the present invention, in which a beam emitting portion and a optical system are accommodated.

FIG. 7 shows the beam adjusting method shown in FIG. 3, and a means in which fine adjustment is carried out in the primary scanning direction and subsidiary scanning direction by a light beam compression prism 200 shown in FIG. 8. Initially, in FIG. 7, as also shown in FIG. 3, the first guiding recesses 124B, 124C formed on the parallel moving member 124, which is parallely moved in the primary scanning direction, are engaged with the guide members 132, 133 provided on the base member 111, and the parallel moving member 124 is fixed to the base member 111 by the fixing screws 134 and 135. The eccentric cam 130 is provided on the axis 131 rotated by a gear $G_7$ and a reduction gear $G_6$. The second cam groove 124A, with which the eccentric cam 130 is engaged, is formed on the parallel moving member 124. The angle changing member 125 is located on the parallel moving member 124. One end of the angle changing member 125 is rotatably provided on the shaft 138. An axis 137 is rotated by a gear $G_9$ and a reduction gear $G_8$. An eccentric cam 136 is provided on the axis 137. The third cam groove 125A with which the eccentric cam 136 is engaged, is formed on the other end of the angle changing member 125. A fixing screw 139 for fixing the angle changing member 125 onto the parallel moving member 124 at the position at which the angle is changed, is provided on the angle changing member 125. Further, the casing 201, in which the semiconductor laser beam emitting body 1A and the collimator lens 2A are provided, is fixed on the angle changing member 125 along the direction of the beam $L_1$. Numerals 219 and 220 are screw rods for adjusting a light beam compression prism 200 (refer to FIG. 8) provided in the casing 201.

By the structure described above, when the parallel moving member 124 is moved in parallel, initially, the hold by the fixing screws 134 and 135 is released; the axis 131 is rotated by the gear $G_7$ and the reduction gear $G_6$; the eccentric cam 130 is rotated; and thereby, the parallel moving member 124 is moved laterally in parallel as shown by the arrow while the first guiding recesses 124B and 124C are engaged with guide members 132 and 133, provided on the base member 111. Due to this movement, the casing 201 provided on the angle changing member 125 can be adjusted so that it moves in parallel to the beam $L_1$. That is, the beam $L_1$ from the semiconductor laser beam emitting body 1A can be adjusted to be emitted in the primary scanning direction. After adjustment has been completed, the parallel moving member 124 is fixed onto the base member 111 by fixing screws 134 and 135. Next, when the angle of the angle changing member 125 is changed, the hold by the fixing screw 139 is initially released; the eccentric cam 136 provided on the axis 137 is rotated by a gear $G_9$ and a reduction gear $G_8$; and thereby, the angle changing member 125 is rotated around the shaft 138 in the arrowed direction through the third cam groove so that its angle is adjusted. By this rotation and adjustment, the angle of the casing 201 provided on the angle changing member 125 is adjusted with respect to the beam $L_1$. That is, the angle of the beam $L_1$ from the semiconductor laser beam emitting body 1A is adjusted.

FIG. 8 shows the casing 201 in which the semiconductor laser beam emitting body 1A, the collimator lens 2A and the beam compression prism 200 are accommodated. Inside the casing 201, a beam transmission hole 203 is formed along the beam $L_1$. A long hole 204 is formed along the beam $L_1$ so that an inner barrel 202, in which the collimator lens 2A is fixed, is mounted in the casing 201. A female screw thread 205 is formed in the long hole 204 so that the the inner barrel 202 can be screwed into the long hole 204. On the other hand, a male screw thread 206 is formed on the outer surface of the inner barrel 202 so that it can be screwed into the female screw thread 205, and the inner barrel 202 is fixed by screws in the long hole 204 as shown in FIG. 8. A tapered surface 207, (at approximately 30° with respect to the horizontal surface), is formed on the surface of the long hole 204 so that the tapered surface of the long hole 204 is extended around the beam $L_1$ in the direction from the portion of the female screw thread 205 to the left in the drawing. A tapered surface 208 is formed on the outer surface of the inner barrel 202 with the same angle as that of the tapered surface 207. A plurality of slits 209, which penetrate the tapered surface 208 to the transmission hole 203 of the beam $L_1$, are formed on the portion on which the tapered surface 208 is formed. The angle θ of the slits is formed at approximately 60°. Numeral 210 is a rotation assembling hole formed at a plurality of portions formed between slits 209. The rotation assembling hole 210 is formed such that it can coincide with an assembling operation long hole 211 formed on the casing 201 at the final assembling position. Numeral 215 is a hole for an adhesive agent 214 and is formed in the casing 201.

The beam compression prism 200 is attached to a beam compression prism attaching member 216 at a predetermined angle. The beam compression prism attaching member 216 is fixed to a cylindrical frame 217. The cylindrical frame 217 is rotatably attached to the beam compression prism attaching portion 218, formed along the long hole 204 in the casing, in the direction crossing the light beam $L_1$. Screw rods 219 and 220, which are screwed into the casing 201, are arranged at a portion of the cylindrical frame 217 symmetrically to each other with respect to a vertical center line of the cylindrical frame in the drawing. A tip of the screw rod 219 directly touches a step portion 221 formed on the cylindrical frame 217. A tip of the screw rod 220 touches a step portion formed on the cylindrical frame 217 through a spring member 222. The cylindrical frame 217 is fixed to the casing 201 by a screw rod 226 through a side plate 224.

In the beam compression prism 200 structured as described above, initially, the screw rod 226 for fixing is loosened, and then, the screw rod 219 is rotated for adjusting. At this time, the step portion 221 formed on a portion of the cylindrical frame 217 is always contacted by the tip of the screw rod 219 through the force of spring member 222. When the screw rod 219 is rotated for adjusting, the light beam compression prism 200 is rotated for adjusting the transmitting direction through the cylindrical frame 217 and the beam compression prism attaching member 216, while the width of the beam $L_1$ is reduced to a predetermined value. After the adjustment is completed, the cylindrical frame 217 is fixed by the screw rod 226 in the casing 201. In this case, even when the screw rod 226 for fixing is rotated clockwise, the tip of the screw rod 219 is always blocked by the step portion 221 formed on the cylindrical frame 217, and the light beam compression prism 200 is not moved from the adjusted position.

The same beam compression prism as the above-described prism 200 is also provided in the casing 201, and the primary scanning direction and the subsidiary scanning direction of luminous flux of the beam $L_1$ emitted from the semiconductor laser beam emitting body 1A, and the beam $L_2$ emitted from the semiconductor laser beam emitting body 1B, are finely adjusted.

As described above, according to the two-beam optical scanning unit of the present invention, the adjusting system for precisely adjusting each beam position of the primary scanning direction and the subsidiary scanning direction, and further, the fine adjusting system for precisely adjusting the rotation, are provided in the unit. Accordingly, the beam position adjustment of the primary scanning direction and the subsidiary scanning direction can be separately and accurately carried out by easy adjustments, which is advantageous.

What is claimed is:

1. An image forming apparatus having a two-beam optical scanning apparatus, comprising:

a pair of semiconductor laser beam emitters, each including at least a semiconductor laser beam emitting body and a collimator lens, and each laser beam emitter generating a respective laser beam so that two laser beams are generated;

a beam composition prism for composing said two laser beams;

a photoreceptor for holding an image written with said two laser beams;

a deflector for deflecting said two laser beams onto said photoreceptor in a primary scanning direction so that said two laser beams are emitted on a primary scanning plane;

two movable supporting units each for respectively movably supporting one of said pair of semiconductor laser beam emitters; and a moving unit for moving at least one of said two supporting units and its laser beam emitter supported thereon so that at least one of said two laser beams is dynamically adjusted to have a predetermined emitting direction.

2. The apparatus of claim 1, wherein said moving unit moves at least one of said two supporting units in a direction parallel to said primary scanning direction of said two laser beams.

3. The apparatus of claim 1, wherein said moving unit moves an angle of at least one of said two supporting units on said primary scanning plane.

4. An image forming apparatus having a two-beam optical scanning apparatus, comprising:

a pair of semiconductor laser beam emitters, each including at least a semiconductor laser beam emitting body and a collimator lens, and each laser beam emitter generating a respective laser beam so that two laser beams are generated;

a beam composition prism for composing said two laser beams;

a photoreceptor for holding an image written with said two laser beams;

a deflector for deflecting said two laser beams onto said photoreceptor in a primary scanning direction so that said two laser beams are emitted on a primary scanning plane;

a beam compression prism, arranged between at least one of said pair of semiconductor laser beam emitters and said beam composition prism, for adjusting an emitting direction of at least one of said two laser beams;

a moving unit for rotating said beam compression prism on said primary scanning plane so that at least one of said two laser beams is shifted in said primary scanning direction to provide dynamic adjustment thereof; and a casing which encloses one of said pair of semiconductor laser beam emitters, said beam compression prism and said moving unit.

5. An image forming apparatus having a two-beam optical scanning apparatus, comprising:

a pair of semiconductor laser beam emitters, each including at least a semiconductor laser beam emitting body and a collimator lens, and each laser beam emitter generating a respective laser beam so that two laser beams are generated;

a beam composition prism for composing said two laser beams;

a photoreceptor for holding an image written with said two laser beams; and a deflector for deflecting said two laser beams onto said photoreceptor in a primary scanning direction so that said two laser beams are emitted on a primary scanning plane; and a movable supporting unit for supporting said beam composition prism;

and wherein said supporting unit is movably arranged in said apparatus so that said movable supporting unit is movable in a direction parallel to said primary scanning plane to adjust a position of said beam composition prism so as to provide dynamic adjustment of the laser beams.

6. The apparatus of claim 5, wherein said supporting unit is movable in a direction parallel to one of said two laser beams which is emitted from one of said pair of semiconductor laser beam emitters.

7. The apparatus of claim 5, further comprising:

a cylindrical lens arranged between said beam composition prism and said deflector;

and wherein said cylindrical lens is coupled with said supporting unit so that said cylindrical lens is movable uniformly with said beam composition prism upon movement of said supporting unit.

8. The apparatus of claim 2, wherein said moving unit includes an eccentric cam for moving at least one of said two supporting units.

9. The apparatus of claim 3, wherein said moving unit includes:

an eccentric cam for moving said angle of at least one of said two supporting units; and a worm gear for rotating said eccentric cam.

10. The apparatus of claim 1, further comprising:

an adjusting hole, provided on an outer body of said apparatus, for allowing said two laser beams to be emitted to a beam position detection unit, provided outside said apparatus, so that at least one of said two laser beams is adjusted so as to have a predetermined emitting direction.

* * * * *